US005826380A

United States Patent [19]

Wolfe

[11] Patent Number: 5,826,380

[45] Date of Patent: Oct. 27, 1998

[54] ROOF RIDGE APPARATUS FOR ADJUSTABLE-PITCH ROOF

[76] Inventor: Michael J. Wolfe, 2408 Navarey St., Safety Harbor, Fla. 34695

[21] Appl. No.: 695,038

[22] Filed: Aug. 9, 1996

[51] Int. Cl.[6] ..... E04D 13/00

[52] U.S. Cl. ..... 52/90.1; 52/71; 52/72; 52/640; 52/277; 52/282.4; 52/800.12

[58] Field of Search ..... 52/90.1, 66, 71, 52/72, 91.3, 640, 641, 277, 278, 282.4, 282.5, 204.1, 211, 212, 204.5, 204.53, 204.66, 204.71, 204.73, 210, 656.2, 467, 582.1, 730.3–730.6, 770–771, 775, 800.12–800.14, 717.02, 716.8; 49/504, DIG. 1

[56] References Cited

U.S. PATENT DOCUMENTS

| | | | |
|---|---|---|---|
| 731,138 | 6/1903 | Stearns | 52/72 |
| 2,051,707 | 8/1936 | Harrison | 52/640 X |
| 2,461,916 | 2/1949 | Omar | 52/71 |
| 3,139,958 | 7/1964 | De Witt | 52/90.1 X |
| 3,210,808 | 10/1965 | Creager | 52/775 X |
| 3,893,269 | 7/1975 | Nelsson et al. | 52/71 X |
| 4,100,704 | 7/1978 | Oogami | 52/277 X |
| 4,606,162 | 8/1986 | Wendt | 52/282.4 |
| 4,663,896 | 5/1987 | Dunnick | 52/71 |
| 4,761,927 | 8/1988 | O'Keeffe et al. | 52/582.1 X |
| 4,872,297 | 10/1989 | Hetzel et al. | 52/640 X |
| 4,934,115 | 6/1990 | Nozaki | 52/71 |

FOREIGN PATENT DOCUMENTS

| | | | |
|---|---|---|---|
| 2634266 | 2/1978 | Germany | 52/71 |
| 3633373 | 4/1988 | Germany | 52/90.1 |

*Primary Examiner*—Carl D. Friedman
*Assistant Examiner*—Laura A. Callo

[57] ABSTRACT

The invention comprises a ridge beam apparatus which is adjustable to receive roof halves in a variety of roof pitches. Such adjustability results from inner and outer sleeves which may rotate about each other through a reasonable range of pitches. The apparatus is suitable for manufacture through the extrusion process.

16 Claims, 4 Drawing Sheets

ROOF RIDGE APPARATUS FOR ADJUSTABLE-PITCH ROOF

The invention generally relates to building frame members which are adapted for receiving structural panels, particularly structural panels with sheet metal surfaces and elongated reinforcing steel members. Reference is made to Disclosure Document No. 399540, filed by the inventor on Jun. 25, 1996, which generally describes the enclosed invention, together with frame members adapted to receive similar panels in other building structures.

BACKGROUND OF THE INVENTION

U.S. Pat. No. 5,373,678, issued to Hesser on Dec. 20, 1994, teaches an improved structural panel in which a light-weight structural material is enclosed between two portions of sheet metal and the combinant panel is further strengthened by reinforcing steel bars which are housed and enclosed within the structural panel sheets.

When uniform structural panels are used to construct all or significant portions of a building, it is useful to formulate a standardized means of framing and positioning the various structural panels. A building will only be as strong as its weakest member. Accordingly, it is important to position and frame the structural panels with framing members which are capable of securing and holding the various portions of such building or structure and will also allow the flexibility of providing a variety of building accessories or options.

Aluminum is a useful material for constructing such building frame members. Aluminum has high strength properties for structural metal applications, has a high resistance to corrosion, is easily fabricated, is reasonably light weight, can be welded or mechanically fastened together, and otherwise has properties making it acceptable as a building material. For instance, it does not become permanently magnetized in the presence of a permanent magnetic field.

Aluminum is also desirable for other reasons. For instance, it is easy to work with and fabricate frame members from aluminum. This is because the appropriate alloys or blends of aluminum can be produced by an extrusion process. Extruding is a very efficient and reliable way to fabricate such building components and is desirable.

Standardization is also very helpful in this regard. There are a variety of building components which lend themselves to standardization. For instance, a typical house will have a pitched roof which extends from eave members along opposite sides through a pitched roof to a ridge top. Additionally, a building will normally have an interior baseboard. Most buildings, whether residential or commercial, will also have a need for conduits and passageways through which electrical, communications, and other wiring or cabling may be passed. Finally, most buildings will require a series of windows or other openings along exterior walls. Accordingly, it is helpful to be able to develop standardized apparatus which may be appropriate to each of these purposes.

Prefabricated, or other forms of standardized or hasty structures, require roofs just like any other. Roofs are complicated portions of the building, typically requiring substructures such as ridge beams, trusses, eaves, and roof framing beams. The pitch of a roof dictates many specific requirements of construction and also may provide important building advantages, as will be discussed in greater detail later. In the construction of such structures, it would be helpful to be able to adjust the pitch of the roof as required for a given construction situation.

U.S. Pat. No. 5,423,157, entitled "Longitudinally Assembled Roof Structure and Method For Making Same", issued to Watanabe, et al, on Jun. 13, 1995, in fact, teaches a roof which is manufactured of longitudinally aligned roof panels. Generally, Watanabe teaches roof panels which comprise interlocking sections so that such panels assemble to one another as they rise from the eaves to the roof-ridge. It can be seen that it would be both difficult and compromise the integrity of the roof panels if it were necessary to cut or sever a given roof panel. This is because it would interrupt the structural integrity of the roof panel as well as the fact that a significant coupling member would be lost by cutting off one of the sides.

Similarly, U.S. Pat. No. 4,729,202, issued to Furland, on Mar. 8, 1988, teaches another roof structure comprising pre-cut roof panels which are longitudinally disposed from eaves to roof-ridge. In the case of Furland, certain fasteners are taught. As with Watanabe, Furland deals with the means of interlocking the longitudinally disposed roof panels to one another.

What is not provided in the prior art is a roof-ridge apparatus which is uniquely adapted to receive roof panels and to permit a roof to be constructed with variable pitch so that it will not be necessary to cut or trim longitudinally disposed roof panels in order to fit the size of a given building. It would also be useful to find such an apparatus which could be manufactured through an extrusion process.

SUMMARY OF THE INVENTION

U.S. Pat. No. 5,373,678, issued to Hesser, on Dec. 20, 1994, teaches a structural wall apparatus. Incorporated within Hesser's structural wall apparatus are building panels which comprise an outer and inner metal skin spaced by an intermediate insulating core of foamed polymer. Each such panel is adapted to have at least one interlocking edge with a metal line tongue in a metal line groove adapted to facilitate interconnection of panels as they are longitudinally interconnected. The panels taught by Hesser also comprise a reenforcing member to the metal skin with a strengthening flange portion on the other side of the metal line groove. Fasteners may be passed through various portions of the interconnecting grooves and flanges in order to facilitate the connection.

While the mechanism taught by Hesser enables adjacent structural panels to interconnect, it does not teach a means of framing the structural panels so as to specifically accommodate certain portions of a building structure, such as the roof, the eaves, the foundational frame members, and the frames for doors and windows.

Such structural panels can be easily fabricated in mass quantities. With appropriate interconnecting members, they can be used for rapid structure of strong and reliable buildings. One of the advantages of such structural panels is in the standardization of the sizes and interconnecting members which not only make them easy to work with but also easy and quick to assemble and train construction workers for accomplishing even what would ordinarily be complicated tasks. Such standardization also facilitates the ability to standardize certain building accessories.

It is well known that roofs are typically made with a pitch. The pitch serves multiple purposes. One purpose is to prevent the accumulation of rainwater or snow or other foreign objects on the roof in order to prevent corrosion or to prevent foreign articles from resting out of sight on the roof. Other purposes may include aesthetics or ventilation considerations. The pitch of the roof may be anywhere from a gradual or shallow angle to a steep or a sharp angle.

Perhaps the most critical portion of any roof structure is the ridge top. At the ridge top, the two sloping halves come together. It is important that the two converging halves fit precisely together so that water intrusion or air filtration will not occur. The ridge connection must be structurally strong and the beam between the halves must cause two sloping members to fit together.

It should be noted that buildings constructed with structural panels such as those taught by Hesser are designed with a variety of pitches generally ranging from a 3" rise in 12" of run to a 12" rise in 12" of run. It is desirable, therefore, to have available a roof ridge member that can accommodate a variety of building designs.

The Inventor has solved this problem by providing a roof ridge member with frame receiving members for receiving the edges of the structural panel members taught by Hesser and further comprise an elongated rotating sleeve member for providing a stable and reliable ridge which can adjust between a range of pitches sufficient to permit any reasonable roof pitch.

It is, then, an object of the present invention to provide a structural beam between the sloped halves of a structural panel roof that will withstand the forces of wind and other elements.

It is a further object that the ridge beam can be thermally broken.

It is, then, an object of the present invention to provide a roof framing structure for framing a roof comprising structural panels such as those taught in Hesser.

It is a further object of the present invention to teach such a roof framing apparatus which can accommodate roofs of adjustable pitch.

It is a further object of the present invention to provide a roof ridge mechanism which will work with a reasonable range of roof pitches as may be required to accommodate specific buildings.

It is a further object of the present invention to provide such a roof ridge apparatus which may be manufactured through an extrusion process.

It is a further object that the beam enables the construction of free standing rigid structures that do not need an elaborate and expensive truss system to support the roof.

It is a further object of the invention to enable the connection of the two sloping roof halves with a thru-bolt connection.

It is a further object of the invention to provide a structural connection at the panel ends which efficiently handles and manages the transfer of positive and negative windloads through the aluminum "U" channel to the foundation.

It is a further object of the invention to improve the current method of framing roof panels in order to better withstand the positive or negative windloads which may be placed upon the building foundation.

Other features and advantages of the present invention will be apparent from the following description in which the preferred embodiments have been set forth in conjunction with the accompanying drawings.

BRIEF DESCRIPTION OF THE DRAWINGS

In describing the preferred embodiments of the invention reference will be made to the series of figures and drawings briefly described below.

Figure 1:
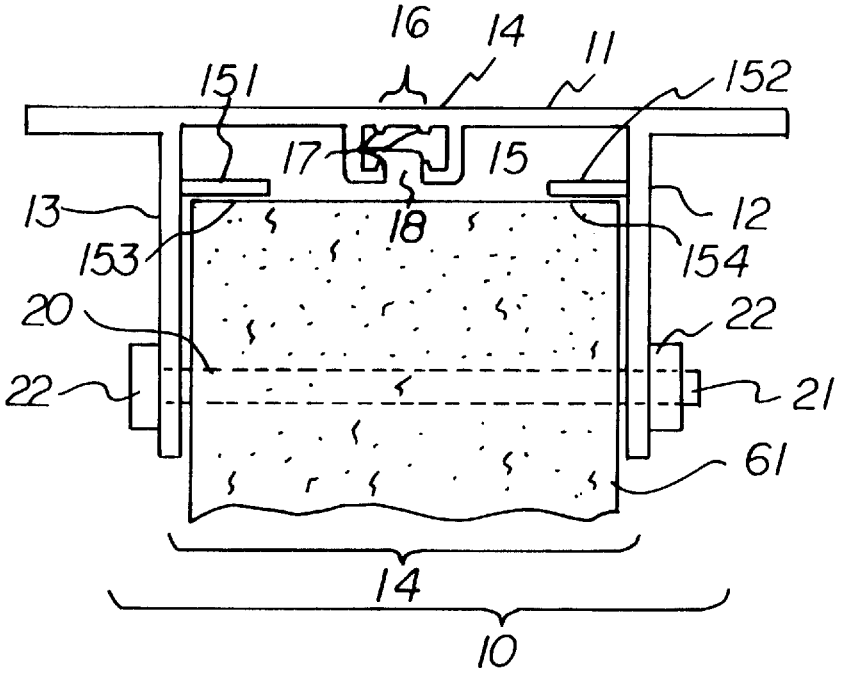
FIG. 1 depicts the basic frame member adapted to receive structural panels as taught in Hesser.

While certain drawings have been provided in order to teach the principles and operation of the present invention, it should be understood that, in the detailed description which follows, reference may be made to components or apparatus which are not included in the drawings. Such components and apparatus should be considered as part of the description, even if not included in such a drawing. Likewise, the drawings may include an element, structure, or mechanism which is not described in the textual description of the invention which follows. The invention and description should also be understood to include such a mechanism, component, or element which is depicted in the drawing but not specifically described.

DETAILED DESCRIPTION OF THE PREFERRED EMBODIMENT

Reference will now be made in detail to the present preferred embodiment of the invention, an example of which is illustrated in the accompanying drawings. While the invention will be described in connection with a preferred embodiment, it will be understood that it is not intended to limit the invention to that embodiment. On the contrary, it is intended to cover all alternatives, modifications, and equivalents as may be included within the spirit and scope of the invention defined in the appended claims.

While the following description will seek to improve understanding of the invention by describing the various components and elements, it should be considered that certain apparatus may be sufficiently and adequately explained by the accompanying drawings, which are fully incorporated herein, and not require further description. All such apparatus should be considered as part of the specification of the invention for all purposes.

As depicted in FIG. 1, a fundamental apparatus for receiving such structural panels is a three-sided frame member which generally describes a "U" or "C" (10). Such would comprise three connected flat sides (11, 12, 13) with two parallel side members (11, 12) which are joined by a perpendicular base member (13). The spacing (14) between the two side members (11, 12) would be such as to snugly receive a structural panel, such as the one taught by Hesser.

Such a general frame structure (10) may easily be manufactured with an extrusion process since all of the surfaces are both straight and uniform. In this manner such a frame member may be fabricated of any desired length and may be cut to any length. Generally speaking, in the extrusion process, an elongated apparatus with a continuous cross section can be manufactured by heating a desired metal (such as an aluminum alloy) and forcing the metal through a cross-sectional die. As the molten aluminum assumes the cross-sectional shape of the form and passes through, it begins to cool and harden. This results in an elongated metallic structure with the desired cross section and of any desired length. This is an efficient and cost-effective means of manufacturing a variety of objects, including frame members, which also produces a consistent structure. Such extrusion method is mentioned by way of general familiarization and is not claimed, in and of itself, as part of this invention. However, the potential for the utilization of extrusion in the practice of this invention is an important consideration when considering its advantages and utility.

While not necessary, as further depicted in FIG. 1, it can be seen that such members may be constructed with a thermal break (15) which reduces the thermal transmission of heat or cold from the outer frame surface to the inner frame surface. This feature is particularly useful for buildings erected in cold climates. The thermal (refer to thermal break U.S. Pat. No. 3,204,324 to "Wilson") break comprises a cavity section (15) with ribbed members (17). The cavity section (15) may be filled with an adhesive binding material (18), such as a liquid urethane, while a portion (16) of the outer cavity (19) can be cut away so as to break the normal continuity in the aluminum base member (10). The structural integrity of the base member (10) through this region is now provided by the binding material (18) and a reduction in thermal transmission is achieved while maintaining the structural integrity of the "C" shaped frame (10) or the structural panel (60) which may be housed within. Such a thermal break (15) may be positioned along the length of any structural panel wall section being contained by the frame section to maintain continuity in the thermally broken and insulated building system.

It should be noted that such thermal breaks can be easily incorporated into an extrusion. It should also be noted that thermal breaks are already well known in the construction art and are not the subject of the present invention. Certain further modifications, innovations, and adaptations of frame members made with thermal breaks, however, are taught herein as means of accomplishing the objectives of the present invention. Such modifications, innovations, and adaptations are the subject of the claims of the present invention.

In these cases one or two positioning platforms (151, 152) could be positioned and inwardly disposed from either side member (12, 13) of the frame (10). Such positioning platforms (151, 152) would have planar surfaces (153, 154) which were perpendicular from the side members (12, 13). If two positioning platforms are used, they are lined up within the same plane. It can be seen that such positioning platforms (151, 152) could easily be included in an extrusion form.

Additionally, such a frame member (10) is amenable to the placement of fastening screws or bolts (21) at any point along its length. Channels (22) may be drilled which pass through the frame member (10), as well as the encased or framed structural panel (20) which may receive a fastening member (21) to hold the structural panel (61) stable within or between the side panels (11, 12) of the frame member (10).

Figures 2, 3:
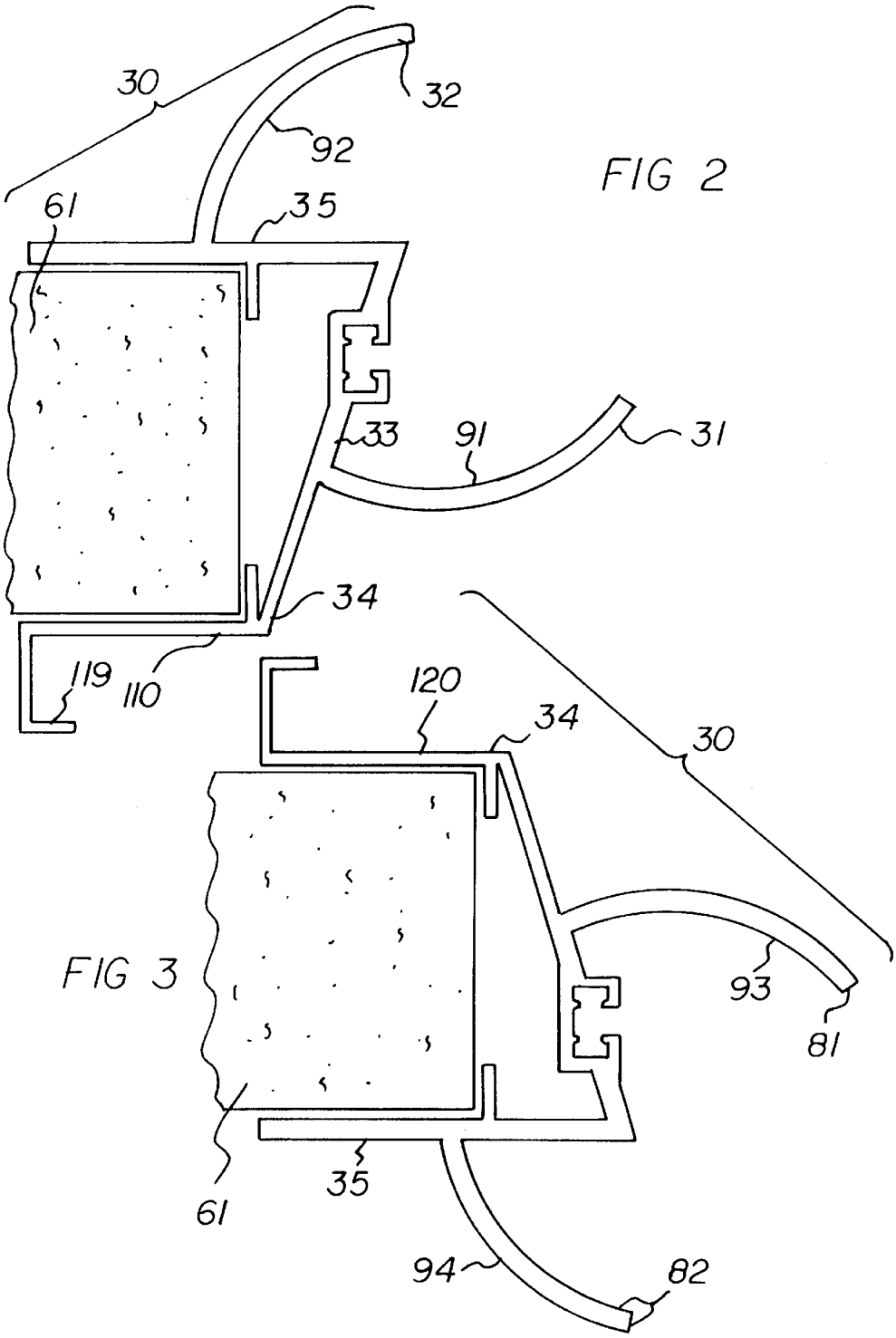
FIG. 2 depicts a cross-section of a roof ridge member according to the present invention with an outer sleeve member.
FIG. 3 depicts a cross-section of a roof ridge member with an inner rotating axle member.

Making reference now to FIG. 2 it can be seen that the basic frame member structure has been substantially modified to form a first roof panel receiving member (110) in order to receive the top edge of a structural roof panel member (61) in a frame (30) which is further adapted with exterior arched flanges (31, 32) which arc out from the base portion (33) and lower side member (35) so as to have inner surfaces (91, 92) which geometrically define two portions of the same circle. Additionally, the base portion (33) of the frame member (30) is angled slightly from the upper side member (34) to the lower side member (35). The importance of this will be discussed later.

Making reference now to FIG. 3 it can be seen that this same modified basic frame member structure has been substantially reproduced in order to form a second roof panel receiving member (120) in order to receive the top edge of a structural roof panel member (61) in a frame (30) which is further adapted with interior arched flanges (81, 82) which arc out from the base portion (33) and lower side member (35) so as to have outer surfaces (93, 94) which geometrically define two portions of the same circle. The circle defined by these flanges (81, 82) is of a dimension to snugly fit and rotate within the circling flanges (31, 32) of the first roof top frame (110) frame. Additionally, the base portion (33) of the frame member (30) is angled slightly from the upper side member (34) to the lower side member (35). The importance of this will be discussed later. The top of this frame side further comprises a fixture (129) for receiving a roof top shroud.

Figure 4:
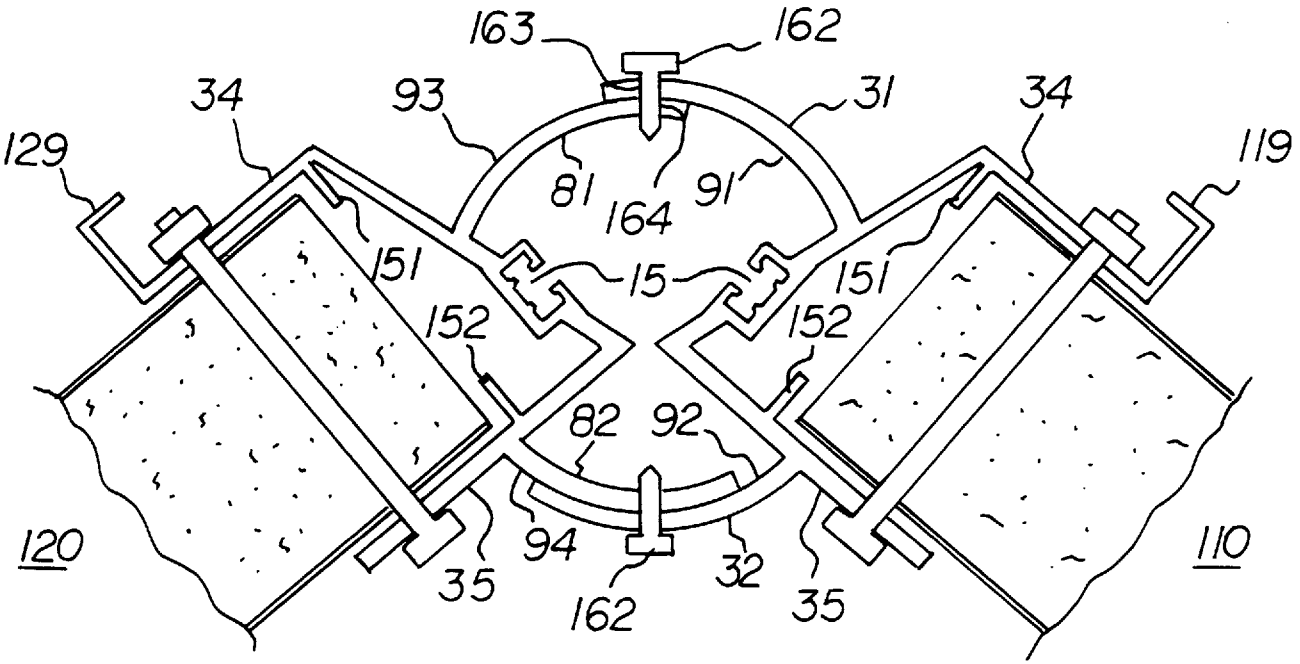
FIG. 4 depicts the cross section of all pieces of the ridge apparatus assembled.

Making reference to FIG. 4, which is the cross section of an assembled roof ridge apparatus, it can be seen that the exterior arch flanges (31, 32) and the interior arch flanges (81, 82) are adapted to rotate about one another within a reasonable range of rotation. The above-described angled base members (30, 50) facilitate this relationship by allowing greater angles through which the rotation may occur.

Making further reference to FIG. 4, it can be seen that locking means could, need not, be applied to the cooperating pairs of flanges (31, 81), or (32, 82). Such locking means could comprise a bolt (162) which could be passed through a hole (163) drilled in an outer flange (31) and a corresponding hole (164) drilled in an inner flange (81). Such locking means can be seen to be possible for either flange pair, but the invention may also be practiced without such locking means. FIG. 4 further shows a shroud (140) comprising two ends joined at an apex and attached to roof top frame members (119,129).

Figure 5B:
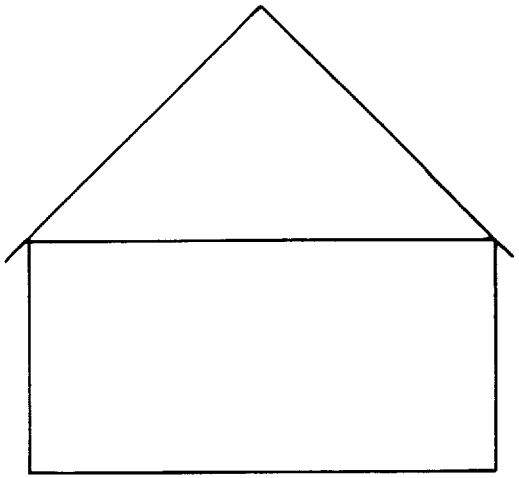
FIGS. 5A and 5B depict two roofs of varying pitch joined with the same roof ridge apparatus.
Figure 5A:
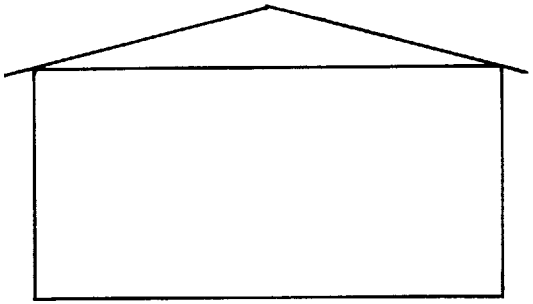

It may now be seen that the cooperating roof ridge frame members rotate about one another so as to accommodate a wide range of pitches for the roof. Of course, it should also be seen that these maximum and minimum pitch angles could be selected to fall within the range of pitches from 3:12 to 12:12, which are generally the minimum and maximum acceptable pitches used with standard roof construction. FIGS. 5A and 5B depict two roofs of varying pitch, but which comprise the same roof member components, particularly referring to the respective roof ridge assembly components and roof panels.

While the apparatus herein has been taught for use with a structural panel of the type of Hesser, it should be noted that such could be used with a variety of structural components, including solid-core structural panels, structural beams (such as four by four wood members commonly used for major frame portions of wooden structures), composite panels; and a variety of others. These frame members have particularly been adapted for use with the Hesser-type panels because a need existed to provide more secure and versatile framing of structural panels which included metal skins and foam interiors. The panels taught herein have thermal expansions which generally are adaptable to fit within a foam material. It should also be noted that for thinner structural panel-type components a thermal break may not be needed. In such a case an offset could be provided simply to accommodate a fastener or the offset could be disposed of altogether.

Thermal breaks should not be considered a necessary part of the invention as taught herein, but have been included the descriptions and drawings in order to demonstrate that the principles of the present invention can work with frame members which may require a thermal break because of their size or other parameters.

Generally speaking, these frames may be adapted to accept panel thicknesses ranging from about two inches to ten inches. When manufactured of aluminum through the extrusion process, they may be manufactured from aluminum of high-strength alloys commonly known as 6005, 6061, or 6063.

The drawings and descriptions further have depicted some rather specific geometrical shapes for the adaptations which receive the window frame, electric conduit shroud, or other features. It can readily be seen that these specific geometrical shapes are not critical to the invention, but what is critical to the invention is that some receiving channel or area be provided to receive the desired structural component, whether it be a conduit or an edge for framing a door or a window.

While the following description will seek to improve understanding of the invention by describing the various components and elements, it should be considered that certain apparatus may be sufficiently and adequately explained by the accompanying drawings, which are fully incorporated herein, and not require further description. All such apparatus should be considered as part of the specification of the invention for all purposes.

It should be noted that those configurations of the present invention which provide for fasteners to be passed through both sides of a frame and an enclosed structural panel utilize the practice of through-bolting. Such improves the ability of the frame to handle both positive and negative wind loads.

Modification and variation can be made to the disclosed embodiments without departing from the subject and spirit of the invention as defined in the following claims. Such modifications and variations, as included within the scope of these claims, are meant to be considered part of the invention as described.

What is claimed is:

1. Apparatus for fastening and securing two halves of a roof along a ridge wherein the two roof halves may be of adjustable pitches, the apparatus comprising:

a first roof panel receiving member, said first roof panel receiving member further comprising three elongated and generally planar sides, said three sides further comprising planar and parallel upper and lower roof panel surface members, said upper and lower roof panel surface members being parallel with each other and spaced so as to snugly receive the upper and lower surfaces of a roof panel member, and a connecting base member, said base member joining said upper and lower roof panel surface members at an angle of less than ninety degrees with said lower roof panel surface member and slightly greater than ninety degrees with said upper roof panel surface member;

a second roof panel receiving member, said second roof panel receiving member further comprising three generally planar sides, said three sides further comprising planar and parallel upper and lower roof panel surface members, said upper and lower roof panel surface members being parallel with each other and spaced so as to snugly receive the upper and lower surfaces of a roof panel member, and a connecting base member, said base member joining said upper and lower roof panel surface members at an angle of less than ninety degrees with said lower roof panel surface member and slightly greater than ninety degrees with said upper roof panel surface member;

each said upper roof panel surface member including a roof top frame member extending therefrom;

said first roof panel receiving member having an elongated arced rotational guide, said elongated arced rotational guide comprising exterior arced rotational flanges extending from beginning points and directions generally perpendicular to said base member and said lower roof panel surface member of said first roof panel receiving member, respectively and each said exterior arced rotational flanges of the elongated arced rotational guide having inner surfaces which arc through portions of the same circle; and said second roof panel receiving member having an elongated arced rotational guide, said elongated arced rotational guide comprising interior arced rotational flanges extending from beginning points and directions generally perpendicular to said base member and said lower roof panel surface member of said second roof panel receiving member, respectively and each said interior arced rotational flanges of the elongated arced rotational guide having outer surfaces which arc through portions of the same circle and with a circle which is congruent with the inner circular surfaces of said first roof panel receiving member so that said rotational guide of said second roof panel receiving member is slidable and rotatable within the rotational guide of said first roof panel receiving member.

2. The roof ridge apparatus described in claim 1 in which either or both base members of said first and second roof panel receiving members include a thermal break attached along its respective length.

3. The roof ridge apparatus described in claim 2 which further comprises rotational locking means, said locking means further comprising one or more pairs of cooperating holes drilled through said interior and exterior rotational flanges through which a bolt or other linear fastener may be passed and secured.

4. The roof ridge apparatus described in claim 2 in which the upper and lower roof surface members of either or both said first and second roof panel receiving members include holes for receiving fasteners in order that said fasteners are positionable through and tightened down upon said roof panel receiving members.

5. The roof ridge apparatus described in claim 4 in which each pair of said upper and lower roof panel surface side members include, on their interior sides perpendicular and planar positioning platforms, said positioning platforms extending for a distance towards the interior of said first and second roof panel receiving members, each said positioning platform further having a planar side which is perpendicular from said upper or lower roof surface side member and which is further directly opposite and co-planar with the opposite positioning platform.

6. The roof ridge apparatus described in claim 5 which further comprises rotational locking means, said locking means further comprising one or more pairs of cooperating holes drilled through said interior and exterior rotational flanges through which a bolt or other linear fastener may be passed and secured.

7. The roof ridge apparatus described in claim 4 which further comprises rotational locking means, said locking means further comprising one or more pairs of cooperating holes drilled through said interior and exterior rotational flanges through which a bolt or other linear fastener may be passed and secured.

8. The roof ridge apparatus described in claim 2 in which each pair of said upper and lower roof surface side members are further adapted, on their interior sides, with perpendicular and planar positioning platforms, said positioning platforms extending for a distance towards the interior of said first and second roof panel receiving members, each said positioning platform further having a planar side which is perpendicular from said upper or lower roof surface side member and which is further directly opposite and co-planar with the opposite positioning platform.

9. The roof ridge apparatus described in claim 8 in which the upper and lower roof surface members of either or both said first and second roof panel receiving members include holes for receiving fasteners in order that said fasteners are positionable through and tightened down upon said roof panel receiving members.

10. The roof ridge apparatus described in claim 9 which further comprises rotational locking means, said locking means further comprising one or more pairs of cooperating holes drilled through said interior and exterior rotational flanges through which a bolt or other linear fastener may be passed and secured.

11. The roof ridge apparatus described in claim 8 which further comprises rotational locking means, said locking means further comprising one or more pairs of cooperating holes drilled through said interior and exterior rotational flanges through which a bolt or other linear fastener may be passed and secured.

12. The roof ridge apparatus described in claim 1 in which the upper and lower roof surface members of either or both said first and second roof panel receiving members are adapted with holes for receiving fasteners in order that said fasteners are positionable through and tightened down upon said roof panel receiving members.

13. The roof ridge apparatus described in claim 12 which further comprises rotational locking means, said locking means further comprising one or more pairs of cooperating holes drilled through said interior and exterior rotational flanges through which a bolt or other linear fastener may be passed and secured.

14. The roof ridge apparatus described in claim 1 in which each pair of said upper and lower roof surface side members are further adapted, on their interior sides, with perpendicular and planar positioning platforms, said positioning platforms extending for a distance towards the interior of said first and second roof panel receiving members, each said positioning platform further having a planar side which is perpendicular from said upper or lower roof surface side member and which is further directly opposite and co-planar with the opposite positioning platform.

15. The roof ridge apparatus described in claim 14 which further comprises rotational locking means, said locking means further comprising one or more pairs of cooperating holes drilled through said interior and exterior rotational flanges through which a bolt or other linear fastener may be passed and secured.

16. The roof ridge apparatus described in claim 1 which further comprises rotational locking means, said locking means further comprising one or more pairs of cooperating holes drilled through said interior and exterior rotational flanges through which a bolt or other linear fastener may be passed and secured.

* * * * *